US012612679B2

(12) United States Patent
Stettner et al.

(10) Patent No.: US 12,612,679 B2
(45) Date of Patent: Apr. 28, 2026

(54) METHOD FOR BREAKING DOWN A MIXTURE OF SOLID PARTICLES COMPRISING RUTHENIUM

(71) Applicant: Heraeus Deutschland Gmbh & Co. KG, Hanau (DE)

(72) Inventors: Martin Stettner, Altenstadt (DE); Magdalena Günther, Biebergemund (DE); Sophia Kröckel, Hanau (DE)

(73) Assignee: HERAEUS DEUTSCHLAND GMBH & CO. KG, Hanau (DE)

( * ) Notice: Subject to any disclaimer, the term of this patent is extended or adjusted under 35 U.S.C. 154(b) by 726 days.

(21) Appl. No.: 17/310,162

(22) PCT Filed: Nov. 29, 2019

(86) PCT No.: PCT/EP2019/083044
§ 371 (c)(1),
(2) Date: Jul. 22, 2021

(87) PCT Pub. No.: WO2020/173589
PCT Pub. Date: Sep. 3, 2020

(65) Prior Publication Data

US 2022/0119915 A1 Apr. 21, 2022

(30) Foreign Application Priority Data

Feb. 28, 2019 (DE) ..... 19159893

(51) Int. Cl.
*C22B 9/16* (2006.01)
*C22B 5/12* (2006.01)
*C22B 11/02* (2006.01)

(52) U.S. Cl.
CPC ..... *C22B 9/16* (2013.01); *C22B 5/12* (2013.01); *C22B 11/02* (2013.01)

(58) Field of Classification Search
CPC ..... C22B 11/04; C22B 11/042; C22B 5/12; C22B 9/16; Y02P 10/20
See application file for complete search history.

(56) References Cited

U.S. PATENT DOCUMENTS

| | | | | |
|---|---|---|---|---|
| 4,682,985 | A * | 7/1987 | Kohl | C10J 3/57 48/209 |
| 8,252,252 | B2 | 8/2012 | Meyer et al. | |
| 8,383,070 | B2 | 2/2013 | Luederitz et al. | |
| 2011/0165041 | A1* | 7/2011 | Meyer | C22B 11/046 423/22 |

FOREIGN PATENT DOCUMENTS

| | | | | |
|---|---|---|---|---|
| CN | 108504867 | A | 9/2018 | |
| DE | 261811 | A1 | 11/1988 | |
| EP | 2348137 | A1 | 7/2011 | |
| EP | 3613863 | A1 * | 2/2020 | C22B 11/04 |
| JP | 2009057611 | A * | 3/2009 | |
| TW | 201026857 | A | 7/2010 | |
| WO | WO-2017071685 | A1 | 5/2017 | |

OTHER PUBLICATIONS

NPL: on-line translation of EP-3613863-A1, Feb. 2020 (Year: 2020).*
NPL: on-pine translation of JP-2009057611-A, Mar. 2009 (Year: 2009).*
International Search Report issued in PCT/EP2019/083044 on Jan. 31, 2020.
European Search Report issued in EP19159893 on Aug. 2, 2019.

* cited by examiner

*Primary Examiner* — Jie Yang
(74) *Attorney, Agent, or Firm* — Blank Rome LLP

(57) ABSTRACT

A method for breaking down a mixture, which is present in the form of solid particles, consisting of: (A) 0 to 99% by weight of metallic ruthenium, (B) 0 to 50% by weight of at least one element other than ruthenium, which is present in elementary form, selected from the group of elements of the atomic numbers 13, 21-30, 39-42, 45-52, and 72-83, (C) 0 to 99% by weight of ruthenium oxide, (D) 0 to 70% by weight of at least one solid element oxide other than ruthenium, (E) 0 to 30% by weight of at least one inorganic substance other than (A) to (D), and (F) 0 to 3% by weight of at least one organic substance, wherein the sum of the % by weight of the compounds (A) to (F) is 100% by weight and the ruthenium content of the mixture is 2 to 99% by weight, and wherein the method comprises the steps of: (1) optionally mixing said mixture with alkali carbonate by forming a blend, (2) alkaline oxidizing breakdown of the mixture or of the blend, respectively, formed in optional step (1) into molten potassium hydroxide using a gaseous oxidizing agent selected from the group consisting of air, oxygen, and air/oxygen mixtures, and without use of nitrate, and (3) cooling down the breakdown material formed in step (2) to a temperature below its solidification temperature, wherein the gaseous oxidizing agent is introduced into the melt in step (2).

17 Claims, No Drawings

METHOD FOR BREAKING DOWN A MIXTURE OF SOLID PARTICLES COMPRISING RUTHENIUM

CROSS REFERENCE TO RELATED APPLICATIONS

This application is a national stage of International Patent Application No. PCT/EP2019/083044, filed Nov. 29, 2019, which the claims the benefit of European Application No. EP 19159893.7, filed Feb. 28, 2019, the entire contents of which are incorporated by reference herein.

The present invention is based on a method for breaking down a mixture of solid particles comprising ruthenium. The fullest possible breakdown of the ruthenium and the extraction of an aqueous solution, which allows for a further purification and extraction of ruthenium or ruthenium compounds, is the goal of the method.

The invention relates to a method for breaking down a mixture, which is present in the form of solid particles, consisting of:

(A) 0 to 99% by weight of metallic ruthenium, (B) 0 to 50% by weight of at least one element other than ruthenium, which is present in elementary form, selected from the group of elements of the atomic numbers 13, 21-30, 39-42, 45-52, and 72-83, (C) 0 to 99% by weight of ruthenium oxide, (D) 0 to 70% by weight of at least one solid element oxide other than ruthenium, (E) 0 to 30% by weight of at least one inorganic substance other than (A) to (D), and (F) 0 to 3% by weight of at least one organic substance, wherein the sum of the % by weight of the compounds (A) to (F) is 100% by weight and the ruthenium content of the mixture is 2 to 99% by weight.

The ruthenium content of the mixture can originate from the compounds (A), (C), (E), each alone, but in particular from a combination (A) plus (C) plus (E) or (A) plus (C) or (A) plus (E) or (C) plus (E).

The mixture, which is to be broken down in the method according to the invention and which is present in the form of solid particles, can originate from different sources. It can be, for example, an ore concentrate or a mixture of a plurality of different ore concentrates of an ore dressing and/or a residue or a mixture of a plurality of different residues, each containing ruthenium, of a precious metal preparation.

Metallic ruthenium of the compound (A) and/or the at least one element (B) other than ruthenium, which is present in elementary form and which is selected from the group of elements of the atomic numbers 13, 21-30, 39-42, 45-52, and 72-83, can be present as alloying constituent.

The solid element oxide or oxides of the compound (D) is in particular one or a plurality of oxides of the elements of the compound (B), alkali metal oxides and/or alkaline earth metal oxides. To avoid misunderstandings, peroxides or super oxides of these elements are ruled out. The elements of the element oxides of the compound (D) can generally have oxidation states in the range of +1 to +4Compound (D) does not comprise any solid element oxides, which are able to convey ruthenium from lower oxidation states into the oxidation state +6.

The at least one inorganic substance of the compound (E) other than the compounds (A) to (D) in particular neither comprises (i) substances, such as, for example, acids, acid salts, acid anhydrides, such as, for example, phosphorous pentoxide or the like, which have a significant acidic reaction, nor (ii) substances, which can be oxidized by means of oxygen under the breakdown conditions of the below-mentioned method step (2) with fire or even explosion. The at least one inorganic substance of the compound (E) other than the compounds (A) to (D) can in particular be selected from the group consisting of (i) silicon dioxide, (ii) of cations optionally present as complex, and of the salts formed of anions selected from the group consisting of silicates, sulfides, phosphides, sulfites, phosphites, sulfates, phosphates, arsenates, antimonates, selenates, and metallates, (iii) oxo compounds, sulfur compounds and/or phosphor compounds other than (i) and (ii) of one or a plurality of metals of the atomic numbers 13, 21-30, 39-50 and 72-83 and (iv) carbon, for example, carbon black or graphite. The inorganic substances of the compound (E) are essentially solids, i.e. the compound (E) consists of 95 to 100% by weight, preferably of 99 to 100% by weight, in particular completely of solids. Compound (E) does not comprise any substances, which are able to convey ruthenium from lower oxidation states into the oxidation state +6.

The mixture, which is to be broken down in the method according to the invention, preferably does not comprise a compound (F). However, it may contain >0 to 3% by weight of the compound (F), but then generally for technical reasons and thus unavoidably.

From a visual aspect, the mixture, which is to be broken down in the method according to the invention, is virtually homogenous, not least as a result of a small particle size of the solid particles of which the mixture consists.

The absolute particle sizes of the solid particles can essentially lie in the micrometer range of, for example, up to 500 μm. The individual or individual solid particles can thereby comprise one or a plurality of the compounds (A) to (F).

In one embodiment, the mixture, which is to be broken down in the method according to the invention, is characterized by a particle size D10 in the range of 0.5 to 1 μm, and a particle size D50 in the range of 2 to 10 μm of the solid particles, of which it consists.

The particle sizes D10 and D50, which are known to the person of skill in the art, can be determined by means of laser diffraction, for example, by means of a corresponding particle size measuring device, for example, by means of a Mastersizer 3000 by Malvern Instruments.

An alkaline oxidizing breakdown of solid mixtures containing ruthenium in an alkali nitrate/potassium hydroxide melt is in each case known from EP 2 090 669 A2, EP 2 236 633 A1, and EP 2 348 137 A1.

It now came as a surprise to applicant that an alkaline oxidizing breakdown of solid mixtures containing ruthenium in molten potassium hydroxide also succeeds without the presence of nitrate. The advantage of this is not only the saving of comparatively expensive nitrate. On the contrary, there are also the advantages specified in the following non-exhaustive list:

Improved utilization of reactor or reaction vessel, in which the alkaline oxidizing melt takes place, due to the omission of the reactor volume, which is otherwise taken up by nitrate.

No nitrate waste water in response to the further reclamation of the breakdown material or no necessity of a leaching of NOx waste gas, respectively, from a nitrate cooking resulting in said leaching.

Simplified further precious metal refining, if the solid particle starting material containing ruthenium contains further precious metals, such as platinum and/or iridium.

The method according to the invention comprises the steps of:

(1) optionally mixing said mixture with alkali carbonate by forming a blend, (2) alkaline oxidizing breakdown of the mixture or of the blend, respectively, formed in the optional step (1) into molten potassium hydroxide using a gaseous oxidizing agent selected from the group consisting of air, oxygen, and air/oxygen mixtures, and without use of nitrate, and (3) cooling down the breakdown material formed in step (2) to a temperature below its solidification temperature, wherein the gaseous oxidizing agent is introduced into the melt in step (2).

For the sake of brevity, the expression "gaseous oxidation agent" will also be used subsequently instead of the expression "gaseous oxidation agent selected from the group consisting of air, oxygen and air/oxygen mixtures".

A feature, which is essential for the invention, of the method according to the invention is that the gaseous oxidation agent is introduced into the melt in step (2). The melt comprises the molten potassium hydroxide, more precisely, the melt only comprises the molten potassium hydroxide at the beginning of step (2), while components of the mixture or of the blend, respectively, melted in the course of step (2) and/or dispersed in the melting phase, as reaction products, forming under the prevailing alkaline oxidizing conditions and which are also molten and/or are dispersed in the melt, are added. Molten compounds of the mixture or of the blend, respectively, as well as molten reaction products can thereby occur in the molten potassium hydroxide in suspended and/or dissolved form.

In one embodiment, the method according to the invention thus comprises the steps of:

(1) mixing said mixture with alkali carbonate by forming a blend, (2) alkaline oxidizing breakdown of the formed blend in molten potassium hydroxide using one of said gaseous oxidation agents and without use of nitrate, and (3) cooling down the breakdown material formed in step (2) to a temperature below its solidification temperature, wherein the gaseous oxidizing agent is introduced into the melt in step (2).

In another embodiment, the method according to the invention comprises the steps of:

(2) alkaline oxidizing breakdown of said mixture in molten potassium hydroxide using one of said gaseous oxidation agents and without use of nitrate, and (3) cooling down the breakdown material formed in step (2) to a temperature below its solidification temperature, wherein the gaseous oxidizing agent is introduced into the melt in step (2).

A differentiation is herein made between the above-mentioned mixture and, if the optional step (1) is realized, the blend formed in step (1) by mixing said mixture with alkaline carbonate.

Method step (1) is optional, method steps (2) and (3), in contrast, take place mandatorily.

In the optional step (1) of the method according to the invention, a blend of mixture and alkali carbonate can be formed by mixing the mixture with alkali carbonate, for example, in a weight ratio of 1 part by weight of mixture: 0.05 to 0.5 parts by weight of alkali carbonate. The alkali carbonate can be used in the mixture in adapted particle size, for example, in powder form. Sodium carbonate and/or potassium carbonate can be used as alkali carbonate; sodium carbonate is preferably used. The person of skill in the art does not need a more in-depth explanation that, from a visual aspect, the blend is also virtually homogenous, not least as a result of the small particle sizes of the solid particles of which the blend consists.

The performance of step (1), which is optional per se, has proven to be advantageous, specifically when performing the method within the technical scale, thus, for example, in the case of batch sizes of 20 and more kg, for example 20 to 1000 kg, of mixture, which is to be broken down.

In step (2), the mixture or, if step (1), which is optional per se, has been realized, the blend in molten potassium hydroxide is broken down using one of said gaseous oxidation agents and without use of nitrate in an alkaline oxidizing manner. "Use of one of said gaseous oxidation agents" means introduction thereof into the melt. "Without use of nitrate" means without the addition of nitrate.

In addition to the gaseous oxidation agent, no nitrate is used or added in step (2). In addition to the gaseous oxidation agent, an oxidation agent other than nitrate is preferably also not used or added, in particular no oxidation agent, which is able to convey ruthenium from lower oxidation steps into the oxidation step +6.

The weight ratio of mixture, which is to be broken down, and potassium hydroxide used in step (2) of the method according to the invention can be, for example, 1 part by weight of mixture: 2 to 5 parts by weight of molten potassium hydroxide; this weight ratio of mixture, which is to be broken down, and potassium hydroxide also applies when working with a blend, which is formed according to step (1) and comprises the mixture.

In step (2) of the method according to the invention, no further substances are preferably used or added in addition to the mixture, which is to be broken down, or the blend (of the mixture, which is to be broken down, and alkali carbonate), respectively, potassium hydroxide and the gaseous oxidation agent.

By nature, step (2) of the method according to the invention comprises the contacting of the mixture or the blend, respectively, with molten potassium hydroxide. The contacting preferably takes place by adding the mixture or the blend, respectively, to a previously produced potassium hydroxide melt. During the addition of the mixture or of the blend, respectively, the potassium hydroxide melt can have a temperature of, for example, in the range of 400 to 800° C. or even 500 to 800° C. The addition of potassium hydroxide melt can take place during a time period of, for example, up to 2 to 5 hours, either continuously or in several portions. The addition speed, more precisely, the average addition speed, can be, for example, 0.04 to 0.25 kg of the mixture or of the blend, respectively, per hour and per kg of molten potassium hydroxide. After addition has ended, the created molten material can advantageously be further mixed, in particular further stirred, for example, at a temperature in the range of 500 to 800° C. or even 600 to 800° C. It can be necessary for this purpose to increase the temperature accordingly with respect to the temperature during the addition to the potassium hydroxide melt. The further mixing can comprise a time period of, for example, 1 to 5 hours.

The gaseous oxidation agent is introduced into the melt in step (2). The gaseous oxidation agent is preferably introduced below the surface of the melt, in particular by blowing in. The introduction can take place by using means, which are suitable for this purpose, such as, for example, as gas introduction tube and/or a gassing agitator, and/or the melt is located in a container or reactor comprising one or a plurality of gas introduction devices in the bottom and/or in the wall. Outflow devices serving for the fine distribution of the gaseous oxidation agent can thereby be used, for example, sieve plates, perforated plates or the like. The devices or surfaces, respectively, which come into contact with the melt, advantageously consist of material, which is alkali-resistant at high temperature, such as, for example, stainless steel.

The introduction of the gaseous oxidation agent can be started, as soon as the potassium hydroxide melt has been formed, or at any time later during step (2), thus during or after addition of the mixture or of the blend, respectively, into the previously prepared potassium hydroxide melt. For example, in the range of 200 to 600 liters of the gaseous oxidation agent are introduced per kilogram of melted potassium hydroxide , for example, during a time period in the range of 3 to 5 hours. The introduction preferably takes place by means of an even volume flow.

A broken down material in the form of a melt, which contains ruthenate ($RuO_4^{2-}$) is obtained at the end of step (2).

Upon completion of step (2), the formed broken down material is cooled down to a temperature below the solidification temperature, for example, to a temperature in the range of 10 to 70° C., in the subsequent step (3). It may be advantageous to move the broken down material still as melt into one or a plurality of vessels, in which an optionally following method step (4) takes place, and to have the cool-down take place therein. The cool-down process usually takes place passively without supporting cooling.

An advantageous method step (4), in particular, can comprise the dissolution of the broken down material, which cooled down and solidified upon completion of step (3), in water or can consist thereof. This can advantageously be done in such a way, for example, that the broken down material is received in water or that water is added to the broken down material. A weight ratio of broken down material: water, which lies in the range of 1:1-5, for example, can be used thereby. The broken down material is advantageously suspended in the aqueous phase, for example, by stirring.

A step (5) of the separation of possible water-insoluble composites of the broken down material from the aqueous solution can follow upon completion of step (4), if necessary. Should the aqueous solution obtained in step (4) thus contain small portions of such water-insoluble compounds, for example, in a magnitude of up to 10% by weight, based on the broken down material, these compounds can be separated in an optional method step (5). Common solid-liquid separating methods, which are known to the person of skill in the art, can be used thereby, for example, decanting, lifting off, filtering off or suitable combinations of such separating methods.

The aqueous solution obtained in step (4) or (5), respectively, contains dissolved ruthenate ($RuO_4^{2-}$) and it can be further processed according to common methods, which are known to the person of skill in the art, for example said methods disclosed in the above-mentioned EP 2 090 669 A2, EP 2 236 633 A1,and EP 2 348 137 A1. The aqueous solution can, for example, be subjected to a treatment with a suitable reducing agent, for example, selected from the group consisting of glucose, primary water-soluble alcohols, and secondary water-soluble alcohols, so as to precipitate $RuO_2$ from the aqueous solution.

The method according to the invention is characterized by an excellent ruthenium activation (ruthenium breakdown ratio). The recovery ratio of the ruthenium as ruthenate in the aqueous solution, for example, is routinely at least 90% to >99%, based on the mixture or blend, respectively, containing ruthenium used in step (2). In other words, the method according to the invention allows for an almost to complete breakdown of ruthenium in mixtures or blends, respectively, of the above-mentioned type with regard to the transfer of ruthenium contained therein into water-soluble ruthenate.

EXAMPLES

Example 1

400 kg of potassium hydroxide were placed into a crucible and were melted at 550° C. 130 kg of an ore concentrate in the form of a mixture of solid particles (D10=0.47 μm, D50=8.55 μm; composition according to X-ray fluorescence (RFA), each in % by weight: 6% Ru, 26% Pt, 12% Pd, 4% Rh, 1% Ir, 3% Se, 3% Fe) were added by stirring for a time period of 3.5 hours. The temperature was then increased to 620° C. and was maintained for a time period of 5 hours under continuous stirring. 152 cubic meters of oxygen were meanwhile introduced into the melt by means of a stainless steel gas lance immersed into the melt. The melt was subsequently poured into melting vats. After the cool-down to 20° C., a total of 600 liters of water was added to the solidified melt and was suspended for 5 hours.

The obtained aqueous suspension was allowed to settle and the excess aqueous solution obtained thereby was decanted and analyzed.

The recovery rate for ruthenium was 98% (calculated from the ruthenium content of the aqueous solution with reference to the used mixture determined by means of inductively coupled plasma emission (ICP)).

Example 2

25 g of potassium hydroxide were melted in a crucible at 570° C. By stirring, a mixture of 10 g of Ru powder and 0.5 g of $RuO_2$ powder were added in portions by stirring. Stirring was subsequently continued at 570° C. for 5 hours, accompanied by a four-hour introduction of a total of 12 liters of oxygen into the melt via a stainless steel gas introduction tube. Cool-down then took place. After the melt had cooled, the residue was dissolved in 150 ml of water and was filtrated subsequently. The dissolution residue was dried and weighed (0.01 g). The aqueous solution was analyzed.

The recovery rate for the ruthenium was 98.79% (calculated from the ruthenium content of the aqueous solution with reference to the used mixture determined by means of inductively coupled plasma emission (ICP)).

What is claimed is:

1. A method for breaking down a mixture, the mixture in the form of solid particles, the mixture consisting of:

(A) 0 to 99% by weight of metallic ruthenium, (B) 0 to 50% by weight of at least one element other than ruthenium, wherein the at least one element is in elementary form and is selected from the group of elements of the atomic numbers 13, 21-30, 39-42, 45-52, and 72-83, (C) 0 to 99% by weight of ruthenium oxide, (D) 0 to 70% by weight of at least one solid element oxide other than ruthenium oxide, (E) 0 to 30% by weight of at least one inorganic substance other than (A) to (D), and (F) 0 to 3% by weight of at least one organic substance, wherein the sum of the % by weight of the compounds (A) to (F) is 100% by weight and the ruthenium content of the mixture is 2 to 99% by weight, wherein the method comprises:

(1) alkaline oxidizing breakdown of the mixture in molten potassium hydroxide using a gaseous oxidizing agent selected from the group consisting of air, oxygen, and air/oxygen mixtures, and (2) cooling down a breakdown material formed in step (1) to a temperature below its solidification temperature to form a solidified broken down material, wherein the gaseous oxidizing agent is only introduced below a surface of the molten potassium hydroxide in step (1), wherein the gaseous oxidizing agent is the only oxidizing agent used in the method, and wherein the methods provide a ruthenium recovery ratio of at least 90%.

2. The method according to claim 1, wherein step (1) is performed with the mixture blended with an alkali carbonate.

3. The method of claim 2, wherein the mixture and the alkali carbonate are blended in amounts that provide a weight ratio of 1 part by weight of the mixture to 0.05 to 0.5 parts by weight of the alkali carbonate.

4. The method of claim 1, wherein the mixture is an ore concentrate or a mixture of a plurality of different ore concentrates of an ore dressing and/or a residue or a mixture of a plurality of different residues, each containing ruthenium, of a precious metal preparation.

5. The method of claim 1, wherein the solid particles exhibit a particle size D10 in the range of 0.5 to 1 μm and a particle size D50 in the range of 2 to 10 μm.

6. The method of claim 1, wherein the weight ratio of the mixture to the molten potassium hydroxide in step (1) is from 1:2 to 1:5.

7. The method of claim 1, wherein in step (1) no further substances are used or added in addition to the mixture, the molten potassium hydroxide and the gaseous oxidizing agent.

8. The method of claim 1, wherein step (1) comprises producing the molten potassium hydroxide prior to the addition of the mixture into the molten potassium hydroxide.

9. The method of claim 8, wherein the molten potassium hydroxide has a temperature in the range of 400 to 800° C. during the addition of the mixture to the molten potassium hydroxide.

10. The method of claim 9, further comprising mixing a molten material, the molten material created upon complete addition of the mixture to the molten potassium hydroxide.

11. The method of claim 8, further comprising mixing a molten material, the molten material created upon complete addition of the mixture to the molten potassium hydroxide.

12. The method of claim 1, further comprising:

(3) dissolving the solidified broken down material in water upon completion of step (2).

13. The method of claim 1, wherein the gaseous oxidizing agent is introduced below a surface of the molten potassium hydroxide using a gas introduction tube.

14. The method of claim 1, wherein the gaseous oxidizing agent is introduced into the molten potassium hydroxide in step (1) using a gassing agitator.

15. The method of claim 1, wherein the gaseous oxidizing agent is introduced into the molten potassium hydroxide in step (1) after addition of the mixture to the molten potassium hydroxide.

16. The method of claim 1, wherein the gaseous oxidizing agent is introduced into the molten potassium hydroxide in step (1) in an amount ranging from 200 to 600 liters of the gaseous oxidizing agent per kilogram of molten potassium hydroxide.

17. The method of claim 16, wherein the gaseous oxidizing agent is introduced into the molten potassium hydroxide in step (1) over a period of time ranging from 3 to 5 hours.

* * * * *